US009869030B2

(12) United States Patent
Curran et al.

(10) Patent No.: US 9,869,030 B2
(45) Date of Patent: Jan. 16, 2018

(54) PROCESS TO MITIGATE SPALLATION OF ANODIC OXIDE COATINGS FROM HIGH STRENGTH SUBSTRATE ALLOYS

(71) Applicant: Apple Inc.

(72) Inventors: James A. Curran, Morgan Hill, CA (US); Sean R. Novak, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/474,021

(22) Filed: Aug. 29, 2014

(65) Prior Publication Data

US 2016/0060783 A1 Mar. 3, 2016

Related U.S. Application Data

(63) Continuation of application No. PCT/US2014/053595, filed on Aug. 29, 2014.

(51) Int. Cl.
*C25D 11/12* (2006.01)
*C25D 11/08* (2006.01)
(Continued)

(52) U.S. Cl.
CPC ..... *C25D 11/12* (2013.01); *C25D 11/04* (2013.01); *C25D 11/08* (2013.01); *C25D 11/10* (2013.01);
(Continued)

(58) Field of Classification Search
CPC ..... C25D 11/14; C25D 11/12; C25D 11/08
(Continued)

(56) References Cited

U.S. PATENT DOCUMENTS 3,388,050 A 6/1968 Wainer et al.
3,411,994 A 11/1968 Wainer et al.
(Continued)

FOREIGN PATENT DOCUMENTS

CH 691064 A5 4/2001
EP 2301760 A2 3/2011
(Continued)

OTHER PUBLICATIONS

Wang et.al. Appl. Phys. Lett., 91, 2007, 1-3.*
(Continued)

*Primary Examiner* — Vera Katz
(74) *Attorney, Agent, or Firm* — Downey Brand LLP

(57) ABSTRACT

Anodic oxide coatings and methods for forming anodic oxide coatings are disclosed. In some embodiments, the anodic oxide coatings are multilayered coatings that include at least two anodic oxide layers formed using two separate anodizing processes. The anodic oxide coating includes at least an adhesion-promoting or color-controlling anodic oxide layer adjacent the substrate. The adhesion-promoting anodic oxide layer is formed using an anodizing process that involves using an electrolyte that prevents formation of delaminating compounds at an interface between the adhesion-promoting anodic oxide layer and the substrate, thereby securing the anodic oxide coating to the substrate. In some cases, the electrolyte includes an organic acid, such as oxalic acid. The anodic oxide coating can also include a cosmetic anodic oxide layer having an exposed surface corresponding to an external surface of the anodic oxide coating. Cosmetic anodic oxide layers can be designed to have a desired appearance or tactile quality.

18 Claims, 9 Drawing Sheets

(51) Int. Cl.

| | |
|---|---|
| ***C25D 11/10*** | (2006.01) |
| ***H05K 5/04*** | (2006.01) |
| ***C25D 11/04*** | (2006.01) |
| *C25D 11/24* | (2006.01) |

(52) U.S. Cl.
CPC ..... *C25D 11/24* (2013.01); *C25D 11/243* (2013.01); *C25D 11/246* (2013.01)

(58) Field of Classification Search
USPC ..... 205/175, 172
See application file for complete search history.

(56) References Cited

U.S. PATENT DOCUMENTS

| | | | | | |
|---|---|---|---|---|---|
| 4,039,355 | A | | 8/1977 | Takahashi et al. | |
| 4,066,516 | A | | 1/1978 | Sato | |
| 4,483,751 | A | | 11/1984 | Murayama et al. | |
| 4,518,468 | A | | 5/1985 | Fotland et al. | |
| 4,606,796 | A | * | 8/1986 | Hanazima | C25D 11/18 205/174 |
| 4,631,112 | A | | 12/1986 | Usui et al. | |
| 4,856,326 | A | | 8/1989 | Tsukamoto et al. | |
| 4,894,127 | A | | 1/1990 | Wong et al. | |
| 5,066,368 | A | | 11/1991 | Pasqualoni et al. | |
| 5,078,845 | A | | 1/1992 | Kunugihara et al. | |
| 5,277,788 | A | * | 1/1994 | Nitowski et al. | 205/175 |
| 5,336,341 | A | | 8/1994 | Maejima et al. | |
| 5,705,225 | A | | 1/1998 | Dornfest et al. | |
| 6,027,629 | A | * | 2/2000 | Hisamoto | B01J 3/006 205/172 |
| 6,339,958 | B1 | | 1/2002 | Tsui et al. | |
| 6,581,446 | B1 | | 6/2003 | Deneuville et al. | |
| 7,527,872 | B2 | | 5/2009 | Steele et al. | |
| 7,732,056 | B2 | * | 6/2010 | Bhatnagar et al. | 428/472.2 |
| 8,691,403 | B2 | | 4/2014 | Amakusa et al. | |
| 9,359,686 | B1 | | 6/2016 | Curran et al. | |
| 2003/0196907 | A1 | | 10/2003 | Viola | |
| 2004/0004003 | A1 | | 1/2004 | Hesse | |
| 2005/0061680 | A1 | | 3/2005 | Dolan | |
| 2006/0019035 | A1 | | 1/2006 | Munz et al. | |
| 2008/0274375 | A1 | * | 11/2008 | Ng | C25D 11/08 428/687 |
| 2008/0283408 | A1 | | 11/2008 | Nishizawa | |
| 2009/0050485 | A1 | | 2/2009 | Wada et al. | |
| 2009/0233113 | A1 | | 9/2009 | Hisamoto et al. | |
| 2010/0024534 | A1 | | 2/2010 | Li et al. | |
| 2010/0264036 | A1 | | 10/2010 | Hatanaka et al. | |
| 2010/0326839 | A1 | | 12/2010 | Morikawa et al. | |
| 2011/0252874 | A1 | | 10/2011 | Patten et al. | |
| 2011/0297319 | A1 | | 12/2011 | Chen et al. | |
| 2012/0298513 | A1 | | 11/2012 | Shimao et al. | |
| 2013/0008796 | A1 | | 1/2013 | Silverman et al. | |
| 2013/0153427 | A1 | | 6/2013 | Tatebe | |
| 2013/0156635 | A1 | | 6/2013 | Lee et al. | |
| 2013/0319872 | A1 | | 12/2013 | Woodhull et al. | |
| 2014/0083861 | A1 | * | 3/2014 | Askin et al. | 205/202 |
| 2016/0237586 | A1 | | 8/2016 | Curran et al. | |
| 2016/0289858 | A1 | | 10/2016 | Curran et al. | |
| 2016/0290917 | A1 | | 10/2016 | Hamann et al. | |
| 2017/0051425 | A1 | | 2/2017 | Curran et al. | |
| 2017/0051426 | A1 | | 2/2017 | Curran et al. | |
| 2017/0088917 | A1 | | 3/2017 | Curran et al. | |

FOREIGN PATENT DOCUMENTS

| | | | | | |
|---|---|---|---|---|---|
| JP | H0347937 | A | | 2/1991 | |
| JP | 2000313996 | | | 11/2000 | |
| JP | 2009209426 | A | | 9/2009 | |
| KR | 20120021616 | | * | 3/2012 | C25D 11/04 |
| KR | 1020120021616 | | | 3/2012 | |
| KR | 101235350 | | * | 2/2013 | C25D 11/04 |

OTHER PUBLICATIONS

PCT Application No. PCT/US2015/010736—International Search Report & Written Opinion dated Nov. 29, 2015.
PCT Application No. PCT/US2015/024349—International Search Report & Written Opinion dated Dec. 17, 2015.
PCT Application No. PCT/US2014/053595—International Search Report & Written Opinion dated Jun. 24, 2015.
Habazaki et al., "Nanoscale Enrichments of Substrate Elements in the Growth of Thin Oxide Films", Corrosion Science, vol. 39, No. 4, pp. 731-737, 1997.
Vesborg et al., "Addressing the terawatt challenge: scalability in the supply of chemical elements for renewable energy," RSC Advances, 2, pp. 7933-7947, 2012.
PCT Application No. PCT/US2015/025000—International Search Report and Written Opinion dated Jan. 26, 2016.
Garcia-Vergara, S. et al; "Morphology of enriched alloy layers in an anodized Al—Cu alloy" Applied Surface Science, 205 (2003),p. 121-127.
Alwitt, R.S. and R.C. McClung , "Mechanical Properties of Anodized Aluminum Coatings"; Proceedings of the SUR/FIN7 '92, American Electroplaters and Surface Finishers Society, Atlanta, Georgia, Jun. 1992.
Yann Goueffon et al., "Study of Degradation Mechanisms of Black Anodic Films in Simulated Space Environment" URL: http://webcache.googleusercontent.com/search?q=cache:fsJq5LjVTVIJ:esmat.esa.int/materials_news/isme09/pdf/6-Contamination/S8%2520-%2520Goueffon.pdf+&cd=1&hl=en&ct=clnk&gl=us.
Henkel Corporation "BONDERITE M-ED 9000 Anodizing Seal (Known as Anoseal 9000)" Technical Process Bulletin Issued Jun. 10, 2013.
Ling Hao and B. Rachel Cheng., "Sealing Processes of Anodic Coatings—Past, Present, and Future", Metal Finishing, vol. 98, Issue 12, Dec. 2000, p. 8-18.
European Patent Application No. 16150283.6—European Search Report dated Jun. 9, 2016.
International Patent Application No. PCT/US2016/043256—International Search Report and Written Opinion dated Oct. 12, 2016.

* cited by examiner

PROCESS TO MITIGATE SPALLATION OF ANODIC OXIDE COATINGS FROM HIGH STRENGTH SUBSTRATE ALLOYS

CROSS-REFERENCE TO RELATED APPLICATION

This is a continuation of International Application PCT/US14/53595, with an international filing date of Aug. 29, 2014, entitled "PROCESS TO MITIGATE SPALLATION OF ANODIC OXIDE COATINGS FROM HIGH STRENGTH SUBSTRATE ALLOYS", which is incorporated herein by reference in its entirety.

FIELD

This disclosure relates generally to anodizing systems and methods. In particular embodiments, systems and methods for mitigating spallation or delamination of anodic oxide coatings are described.

BACKGROUND

Anodizing is a method of providing an anodic oxide layer or coating on a metal substrate, often used in industry to provide a protective and sometimes cosmetically appealing coating to metal parts. During an anodizing process, a portion of the metal substrate is converted to a metal oxide, thereby forming the anodic oxide layer or coating. The nature of the anodic coatings can depend on a number of factors, including chemical makeup of the metal substrates and the process parameters used in the anodizing processes. In some applications, the anodic oxide is colored by infusing one or more dyes within the anodic oxide, giving the metal substrate an attractive colored surface coating.

Unfortunately, in some cases where certain metal alloy substrates are used, the anodic oxide coatings can peel, chip or otherwise delaminate from their metal substrates when exposed to scratching or scraping forces during normal use of the part. This delamination can cause the underlying metal substrate to be exposed at the chipped or peeled regions. If the anodic oxide coatings are dyed, the exposed underlying metal substrate, which is generally a bright metallic color, can be readily apparent, especially if the anodic oxide coating is dyed a dark color.

SUMMARY

This paper describes various embodiments that relate to anodizing processes and anodic oxide coatings using the same. The systems and methods described are used to form anodic oxide coatings that are resistant to delamination due to chipping or spalling.

According to one embodiment, a method of forming an anodic oxide coating on a substrate is described. The substrate includes at least one alloying agent. The method includes forming a cosmetic anodic oxide layer by anodizing the substrate in a first electrolyte. The method also includes forming an adhesion-promoting anodic oxide layer between the cosmetic anodic oxide layer and the substrate by anodizing the substrate in a second electrolyte different than the first electrolyte. The second electrolyte is characterized has having a chemical composition that prevents the at least one alloying agent in the substrate from transforming into a delaminating compound at an interface between the adhesion-promoting anodic oxide layer and the substrate. The delaminating compound is associated with reducing adhesion strength between the anodic oxide coating and the substrate.

According to another embodiment, a part is described. The part includes a substrate made of an aluminum alloy that includes zinc. The part additionally includes an anodic oxide coating disposed on the substrate. The anodic oxide coating includes a cosmetic anodic oxide layer having an exposed surface corresponding to an exterior surface of the part. The anodic oxide coating also includes an adhesion-promoting anodic oxide layer positioned between the cosmetic anodic oxide layer and the substrate and adhered to the substrate. The adhesion-promoting anodic oxide layer is substantially free of sulfur and sulfur-containing species.

According to a further embodiment, a method of forming an anodic oxide coating on a substrate is described. The anodic oxide coating includes a cosmetic anodic oxide layer and an adhesion-promoting anodic oxide layer. The method includes converting a first portion of the substrate to the cosmetic anodic oxide layer in a sulfuric acid electrolyte. The method further includes converting a second portion of the substrate to the adhesion-promoting anodic oxide layer in an oxalic acid electrolyte such that the adhesion-promoting anodic oxide layer is positioned between the cosmetic anodic oxide layer and the substrate. The adhesion-promoting anodic oxide layer is adhered to the substrate.

According to an additional embodiment, a method of forming an anodic oxide coating having a predetermined color on a substrate is described. The anodic oxide coating includes a substantially colorless cosmetic anodic oxide layer and a color-controlling anodic oxide layer. The method includes converting a first portion of the substrate to the substantially colorless cosmetic anodic oxide layer in a first electrolyte. The method also includes converting a second portion of the substrate to the color-controlling anodic oxide layer in a second electrolyte different than the first electrolyte. The second electrolyte includes an organic acid that imparts a color to the color-controlling anodic oxide layer. A thickness of the color-controlling oxide layer is chosen to impart the pre-determined color to the anodic oxide coating.

According to another embodiment, a method of avoiding delamination of an anodic oxide coating from an aluminum substrate comprising zinc is described. The method includes forming an adhesion-promoting anodic oxide layer adjacent to the aluminum substrate by anodizing the aluminum substrate in an electrolyte that is substantially free of sulfur or sulfur containing species such that the adhesion-promoting anodic oxide layer includes less than about 3% by weight of sulfur or sulfur containing species.

These and other embodiments will be described in detail below.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
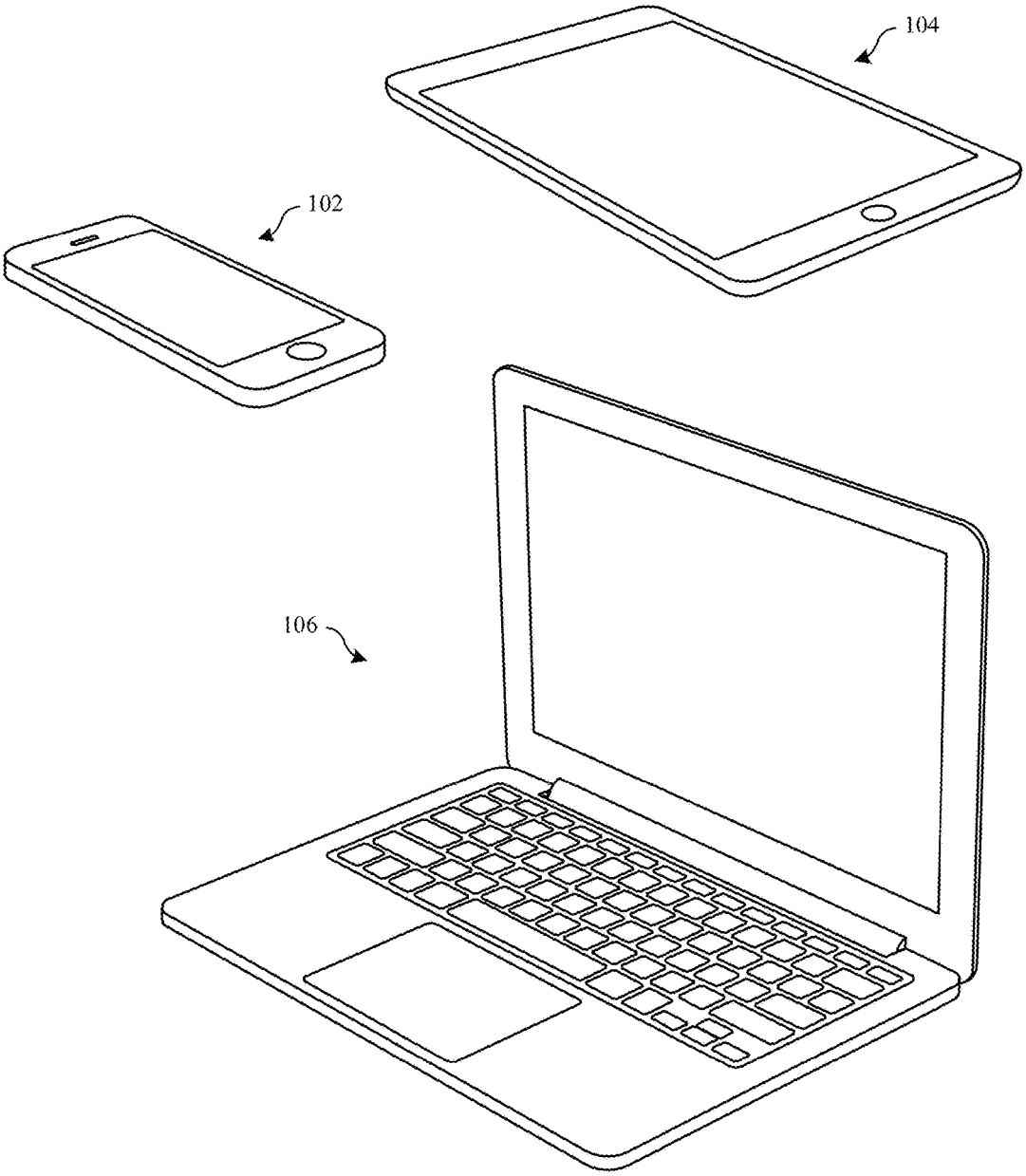
FIG. 1 shows perspective views of devices having metallic surfaces that can be protected using anodic oxide coatings, in accordance with described embodiments.

Reference will now be made in detail to representative embodiments illustrated in the accompanying drawings. It should be understood that the following descriptions are not intended to limit the embodiments to one preferred embodiment. To the contrary, they are intended to cover alternatives, modifications, and equivalents as can be included within the spirit and scope of the described embodiments as defined by the appended claims.

Described herein are processes to mitigate edge chipping or delamination of an anodic oxide coating formed on a body made of anodizable material, such as aluminum and alloys thereof. The processes include at least two successive anodizing operations, which are of such nature as to yield porous oxides. In particular embodiments, the final anodizing operation is performed in an electrolyte comprising an organic acid as the dominant acid. This provides a robust adhesion between the anodic oxide coating and the aluminum substrate. According to some embodiments, at least a third of the final coating thickness is formed in an inorganic electrolyte (such as a sulfuric or phosphoric acid electrolyte), such that discoloration of the resulting oxide film is minimized. In some cases, preferably half or more of the final coating thickness is formed in an inorganic electrolyte. In some cases, about 80 percent or more of the final coating thickness is formed in an inorganic electrolyte.

According to some embodiments, the two or more successive anodizing operations include a first conventional sulfuric acid anodizing operation, producing an outer layer of the anodic oxide coating, and which exhibits the clarity, texture and cosmetic quality necessary for some application process requirements. In some cases this outer layer is dyed and sealed. A second, subsequent, anodizing operation is performed in an electrolyte containing an organic acid or predominantly organic acid as its active ingredient. In some embodiments, the second anodizing process is performed in an electrolyte containing an organic acid (e.g., oxalic acid, citric acid, malic acid, malonic acid, glycolic acid, acetic acid, tartaric acid). In some embodiments, the second anodizing process is performed in an electrolyte containing an inorganic acid that is substantially free of sulfur (e.g., phosphoric acid). In some embodiments, the second anodizing operation is performed at substantially the same current density to the first anodizing operation, yielding similar anodic oxide growth rates. In other embodiments, the second anodizing operation is performed at higher or lower current density than the first anodizing operation, or under voltage control. The second anodizing operation yields a different interface structure between the anodic oxide layer and the substrate, which exhibits lower residual stresses than the first sulfuric acid anodizing operation. This makes the surface finish less susceptible to delamination and chipping during the service life of a part.

A notable benefit of the structures and methods described is the possibility of tuning the color of an anodic oxide coating by varying relative thicknesses of two anodic oxide layers. For example, one of the anodic oxide layer formed in a predominantly organic electrolyte can have a strong thickness-dependent color. By varying the thickness of this anodic oxide layer, a wide range of shades of gold, bronze and gray can be achieved, whilst the total thickness of the protective anodic oxide coating is independently controlled by an additional thickness of a second anodic oxide layer grown predominantly in an inorganic acid and that is relatively clear or colorless.

Methods described herein are well suited for providing cosmetically appealing surface finishes to consumer products. For example, the methods described herein can be used to form durable and cosmetically appealing finishes for housing for computers, portable electronic devices and electronic device accessories, such as those manufactured by Apple Inc., based in Cupertino, Calif.

These and other embodiments are discussed below with reference to FIGS. 1-8. However, those skilled in the art will readily appreciate that the detailed description given herein with respect to these Figures is for explanatory purposes only and should not be construed as limiting.

As described above, methods described herein can be used to form durable and cosmetically appealing coatings for metallic surfaces of consumer devices. FIG. 1 shows consumer products than can be manufactured using methods described herein. FIG. 1 includes portable phone 102, tablet computer 104 and portable computer 106, which can each include metal surfaces. Devices 102, 104 and 106 can be subject to impact forces such as scratching, dropping, abrading, chipping and gouging forces during normal use. Typically the metal surfaces are anodized in order to add a protective anodic oxide coating to these metal surfaces. However, it has been found that the adhesion strength of the anodic oxide coatings can depend, at least in part, on the type of metal used for the metal surfaces. For example, some stronger and stiffer aluminum alloys, although they can provide good structural integrity to devices 102, 104 and 106, can also form anodic oxide coatings that are more prone to chipping, scratching and otherwise marring caused by impact forces. In particular, the anodic oxide coatings can have a tendency to chip, spall, blister or delaminate under surface impact, revealing bright spots of the bare substrate alloy that can detract from the cosmetic appearance of devices 102, 104 and 106. Metal surfaces at edges and corners of devices 102, 104 and 106 can be especially vulnerable to this chipping and delamination. The anodizing methods described herein involve anodizing techniques that provide anodic oxide coatings having improved resistance to chipping and delamination compared to conventional anodic oxide coatings.

Figure 2:
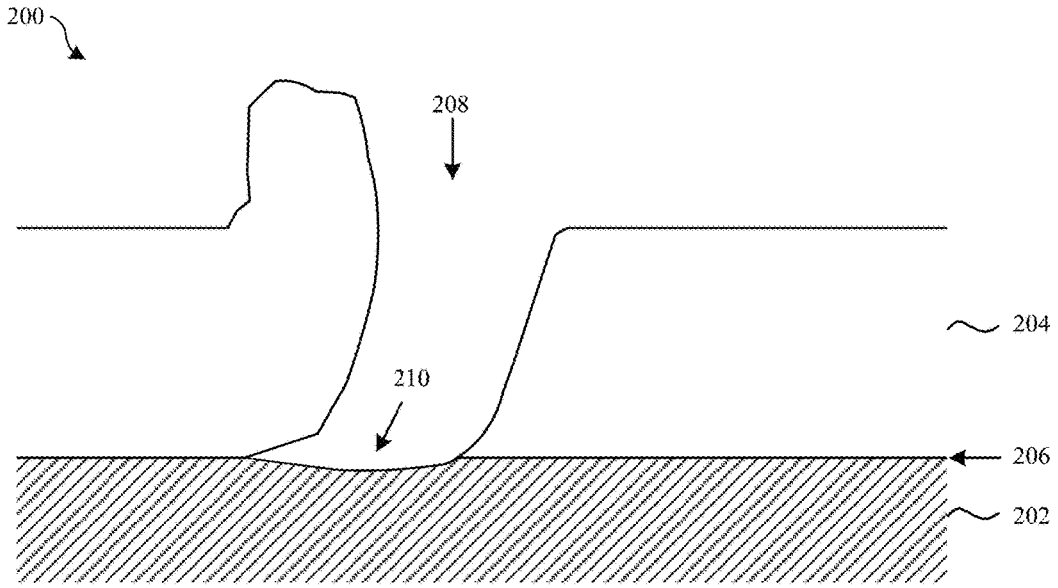
FIG. 2 shows a cross-section view of a surface of a part having a visible chip caused by anodic oxide coating delamination.

To further demonstrate the chipping and delamination that can occur using conventional anodic oxide coatings, FIG. 2 shows a cross-section view of part 200, which includes substrate 202 with anodic oxide coating 204 formed using a conventional anodizing method. During the anodizing process, a surface portion of substrate 202 is converted to anodic oxide coating 204. Thus, anodic oxide coating 204 is integrally formed on and interfaces with substrate 202 at the grain boundary or interface 206. FIG. 2 shows part 200 after exposure to an impact event, such as exposure to a scratching, chipping or similar impact force. The impact event causes a portion of anodic coating 204 to peel away from or delaminate from substrate 202 at interface 206, forming chip 208. Chip 208 can expose and visibly reveal a portion of underlying substrate 202 at delaminated area 210. In some cases, the impact forces can cause chip 208 to gouge into and deform or remove portions of substrate 202 at delaminated area 210. The visibility and/or tactility of chip 208 can depend on the size and depth of chip 208, as well as the colors of anodic oxide coating 204 and substrate 202. In some cases, anodic oxide coating 204 is dyed to have a particular color, which can contrast with the color of substrate 202. For example, anodic oxide coating 204 can be dyed to have a red, blue, green, yellow or black color, while substrate 202 can have a bright silver color with a metallic luster. In general, the higher the contrast between the colors of anodic oxide coating 204 and substrate 202, the more visible chip 208 is.

One reason that anodic oxide coating 204 is prone to delamination is poor adhesion of anodic oxide coating 204 to substrate 202 at interface 206. In some cases, it has been found that some anodizing process can cause chemical species to form at interface 206 during the anodizing process. These chemical species can come from substrate 206. For example, substrate 202 can be made of an alloy, such as an aluminum alloy, that contains alloying agents. Typical aluminum alloying agents include one or more of zinc, silicon, iron, copper, manganese, magnesium, chromium, vanadium, titanium, bismuth, gallium, lead and zirconium. In particular, some stiffer aluminum alloys can contain zinc in varying amounts. Alloying agents can provide desired physical and functional qualities, such as a hardness or ductility, to substrate 202 and part 200. However, in some cases one or more of these alloying agents can aggregate and become enriched at interface 206 during an anodizing process. It has been found that particular alloying agents enriched at interface 206 can combine with one or more chemical species within an anodizing electrolyte to form delaminating compounds that can weaken the bonding between anodic oxide coating 204 and substrate 202 at interface 206.

In some cases, it has been found that zinc from some aluminum alloy substrates can become enriched at interface 206 forming a very thin layer of zinc, having an estimated thickness of about 2 nanometers. The enriched zinc layer can combine with sulfur-containing species from a sulfuric acid electrolyte forming one or more zinc and sulfur containing compounds, such one or more zinc sulfate compounds. These one or more zinc and sulfur containing compounds can act as delaminating compounds in that it can disrupt proper adhesion of anodic oxide coating 204 to substrate 202. It should be noted that delamination compounds are not limited to zinc and sulfur containing compound and that other alloying agents and anodic electrolyte chemical species can combine to form other types of delamination agents at interface 206.

Another possible factor that may contribute to delamination of anodic oxide coating 204 can include a mismatch between the mechanical properties of the substrate 202 and anodic oxide coating 204. A further contribution to delamination can include greater local residual stresses in some harder aluminum alloys compared to less hard aluminum alloys.

The anodizing methods described herein can be used to form anodic oxide coatings that are more resistant to delamination and spalling described above with reference to FIG. 2. The anodic oxide coatings can be integrally formed on any suitable metal surface of parts, such as devices 102, 104 and 106, including at edges and corners, to protect and/or cosmetically enhance their appearances. The anodic oxide coatings are resistant to delamination, thereby providing robust and wear-resistant coatings for devices 102, 104 and 106. In some cases, the anodic oxide coatings are dyed to have any of number of suitable colors. Thus, the anodic oxide coatings can provide consistently colored coatings that can last throughout the consumer lifetimes of devices 102, 104 and 106. Note that methods described herein can be used to provide anodic oxide coatings for any suitable substrate or part and are not limited to the types of devices shown in FIG. 1.

In some embodiments, the anodizing methods involve forming a multilayered anodic oxide coating that includes at least an adhesion-promoting anodic oxide layer that provides good adhesion at a grain boundary between the multilayered anodic oxide coating and a substrate. The multilayered anodic oxide coating can also include a cosmetic anodic oxide layer that is positioned above adhesion-promoting anodic oxide layer and provides a desired cosmetic quality, such as a desired clarity, particular color and/or tactile quality.

In some embodiments, the cosmetic anodic oxide layer corresponds to a conventional sulfuric acid electrolyte anodic oxide coating, deemed desirable and suitable for skin contact in certain consumer products. More specifically, anions that may cause a degree of skin irritation can become incorporated from certain anodizing electrolytes into the adhesion-promoting anodic oxide layer, which can be undesirable in some consumer product applications where a high degree of skin contact is expected. The cosmetic anodic coating can provide an advantage of providing a barrier between the adhesion-promoting oxide layer and an external surface of a part thereby avoiding direct contact with the adhesion-promoting anodic oxide layer by a user of the consumer product. By first forming a cosmetic anodic oxide layer corresponding to an exposed surface of the part in a conventional sulfuric acid electrolyte, it can be ensured that the outer portion of the anodic oxide coating is one that is well suited for skin contact.

Figure 3A:
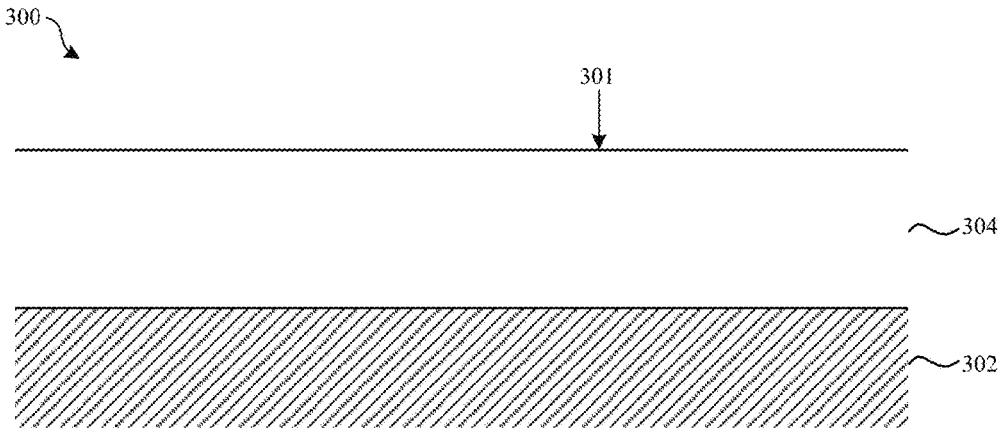
FIGS. 3A and 3B show cross-section views of a surface of a part undergoing an anodizing process for forming a delamination-resistant anodic oxide coating, in accordance with described embodiments.
Figure 3B:
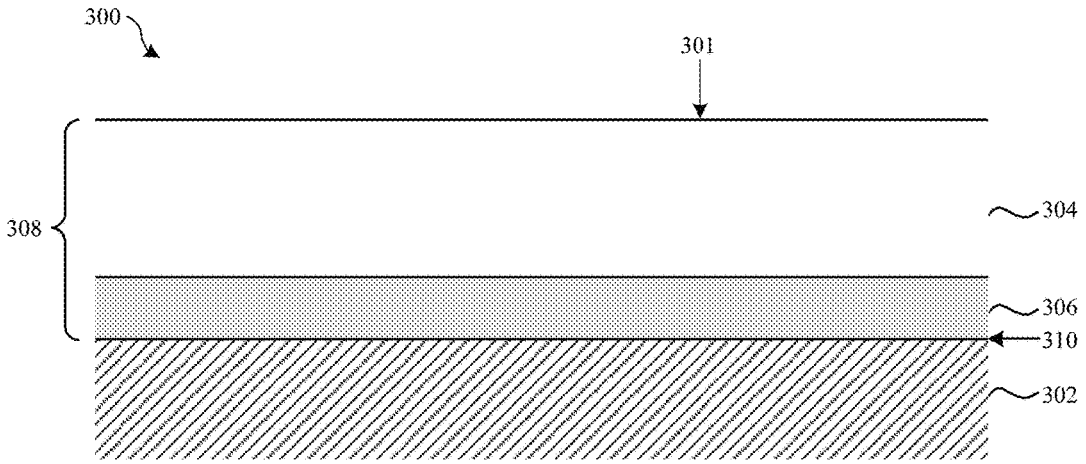

FIGS. 3A and 3B show cross-section views of part 300 undergoing an anodizing process for forming a multilayered anodic oxide coating, in accordance with described embodiments. At FIG. 3A, a portion of substrate 302 is converted to cosmetic anodic oxide layer 304. Substrate 302 can contain any suitable anodizable material, including but not limited to one or more of aluminum, titanium, magnesium, niobium, zirconium, hafnium and tantalum. In some embodiments, substrate 302 is an alloy that contains alloying agents, such as one or more of zinc, silicon, iron, copper, manganese, magnesium, chromium, vanadium, titanium, bismuth, gallium, lead and zirconium. In some cases, the alloy material of substrate 302 is chosen for its mechanical properties, such as hardness, ductility, density, tensile strength, workability and/or corrosion resistance. In some cases, the alloy material of substrate 302 is chosen for its cosmetic properties such as color and/or visual brightness. In some cases, the alloy material of substrate 302 is chosen for a combination of mechanical and cosmetic properties.

According to some embodiments, substrate 302 includes a 7000 series aluminum alloy. In particular embodiments, substrate 302 is a high-strength aluminum alloy that includes zinc (e.g., certain 7000 series alloys).

Cosmetic anodic oxide layer 304 can be formed using any suitable anodizing process. Cosmetic anodic oxide layer 304 corresponds to an outer anodic oxide layer and therefore can correspond to the most visible portion of the multilayered anodic coating. Surface 301 of cosmetic anodic oxide layer 304 can correspond to an exterior surface of part 300. Cosmetic anodic oxide layer 304 can be made to have a particular cosmetic appearance. For example, cosmetic anodic oxide layer 304 can have a particular color (hue) or transparency. One can control the appearance of cosmetic anodic oxide layer 304 by controlling anodizing process parameters. For example, anodizing in oxalic acid can result in an anodic oxide layer having a gold, bronze or yellowish hue compared to some inorganic acid electrolytes. Anodizing in malic acid or malonic acid can result in an anodic oxide layer having a dark yellow or brown hue. In some applications, a gold, bronze, yellow or brown hue can be undesirable where a more transparent and non-colored anodic oxide layer is desired. Thus, it may be desirable to use an electrolyte that produces a more colorless and transparent quality. In some cases, this can be accomplished using an electrolyte having one or more inorganic acids, such as sulfuric acid and/or phosphoric acid. In a particular embodiment, a sulfuric acid electrolyte is used to form cosmetic anodic oxide layer 304 having a substantially colorless and transparent appearance. In some embodiments, the color of a final anodic oxide coating can also be controlled by varying anodizing process parameters and/or a thickness of a subsequently formed adhesion-promoting oxide layer, which will be described in detail below with reference to FIG. 3B.

Other factors in determining an appearance of cosmetic anodic oxide layer 304 include material type of substrate 302. For example, aluminum alloys having relatively high amounts of copper can be associated with an anodic oxide layer having a yellowish hue. According to some embodiments, substrate 302 is made of a copper-lean (having none or relatedly low amounts of copper) aluminum alloy and a inorganic acid (e.g., sulfuric acid) electrolyte is used, resulting in cosmetic anodic oxide layer 304 having a substantially transparent and color-less appearance.

In some embodiments, the anodizing process includes use of a sulfuric acid electrolyte with a concentration ranging from about 100 grams/liter and about 300 grams/liter of sulfuric acid using a current density of about 0.5 Amps/$dm^2$ and about 3 Amps/$dm^2$. In a particular embodiment, a sulfuric acid electrolyte with a concentration of about 150 grams/liter to about 250 grams/liter sulfuric acid, a current density of about 1 to about 2 Amps/$dm^2$ and an electrolyte temperature around room temperature (e.g., about 20 C to about 30 C) is used. For voltage control processes (compared to current density control processes), the voltage nominally ranges between about 8 volts and about 20 volts. In some embodiments, a mixed acid (e.g., sulfuric acid and oxalic acid) electrolyte is used. Cosmetic anodic oxide layer 304 can be grown to any suitable thickness. In some embodiments, cosmetic anodic oxide layer 304 is grown to a thickness of between about 5 and 30 micrometers. In a particular embodiment, cosmetic anodic oxide layer 304 is grown to a thickness of about 6 to about 20 micrometers.

At FIG. 3B, another portion of substrate 302 is converted to adhesion-promoting anodic oxide layer 306 such that adhesion-promoting anodic oxide layer 306 is positioned between substrate 302 and cosmetic anodic oxide layer 304. Compared to cosmetic anodic oxide layer 304, adhesion-promoting anodic oxide layer 306 can be designed for good adhesion to substrate 302 and with less emphasis on cosmetic appearance. As described above with reference to FIG. 2, some anodic oxide coatings are prone to delamination due to reactions between chemical species within the electrolyte and the build up of alloying agents at the interface between the anodic oxide coating and the substrate.

In order to provide better adhesion to substrate 302, adhesion-promoting anodic oxide layer 306 is formed using an anodizing process that promotes better adhesion. In particular, this involves using an anodizing process using a second electrolyte characterized has having a chemical composition that prevents one or more alloying agents in the substrate from transforming into a delaminating compound at interface 310 between the adhesion-promoting anodic oxide layer 306 and the substrate 302. In some embodiments, this involves using a second electrolyte that is substantially free of chemical species that can bind with alloying agents enriched at interface 310 to form these delaminating compounds at interface 310. This way, interface 310 is substantially free of delamination compounds and allows for less residual stress at interface 310, thereby creating a strong adhesion between anodic oxide coating 308 and substrate 302. The stronger adhesion reduces the occurrence of delamination described above with respect to FIG. 2. These aspects will be discussed below in detain with reference to FIG. 3C.

The type of chemical species within the electrolyte to avoid can vary depending on the material of substrate 302 and the types of alloying agents within substrate 302. In some cases, using an organic acid (e.g., oxalic acid) instead of an inorganic acid (sulfuric acid or phosphoric acid) electrolyte provides this result. In some cases the organic acid need only be the predominant acid within an organic acid/inorganic acid electrolyte. In some particular embodiments where substrate 302 is an aluminum alloy containing zinc, the electrolyte is substantially free of sulfur species, such sulfur species from a sulfuric acid electrolyte. This is because it has been found that sulfur species can combine with zinc that accumulates at interface 310 of some aluminum alloys, as described above. In these embodiments, adhesion-promoting anodic oxide layer 306 would be substantially free of sulfur and sulfur-containing species, meaning about 3% or less by weight of sulfur or sulfur containing species. In some embodiments, adhesion-promoting anodic oxide layer 306 preferably contains less than about 2% by weight of sulfur or sulfur containing species. In some embodiments, adhesion-promoting anodic oxide layer 306 preferably contains less than about 1% by weight of sulfur or sulfur containing species. This is in comparison to anodic oxide layers formed using sulfuric acid electrolytes that can include between about 10% to about 15% by weight sulfur or sulfur containing species.

Suitable substitutes for sulfuric acid electrolytes include organic acid electrolytes (e.g., oxalic acid, citric acid, malic acid, malonic acid, glycolic acid, acetic acid and tartaric acid electrolytes). In a particular embodiment, an oxalic acid electrolyte is used. In other embodiments, the electrolyte includes an inorganic electrolyte that is free of sulfur, such as a phosphoric acid electrolyte. It should be noted that in some embodiments an organic acid electrolyte is preferable over non-sulfur inorganic electrolytes. Note that since cosmetic anodic oxide layer 304 is positioned above adhesion-promoting anodic oxide layer 306, cosmetic anodic oxide layer 304 can act as a barrier to avoid direct skin contact with adhesion-promoting anodic oxide layer 306. This can be useful in situations where adhesion-promoting anodic oxide layer 306 may contain skin irritants.

Note that in some embodiments, formation of delaminating compounds at interface 310 can alternatively or additionally be deterred by introducing chemical species that can block the combining of chemical species within the second electrolyte and alloying agents within substrate 302. For example, substrate 302 can include copper as an alloying agent that can block the combining of zinc (another alloying agent within some substrates) with sulfur species within the second electrolyte, thereby preventing formation of zinc and sulfur containing delaminating compounds within interface 310. However, too much copper within substrate 302 can cause substrate 302 (and the resultant anodic oxide coating) to have a yellow hue, which may be undesirable in certain applications. These factors should be considered when designing an appropriate anodizing process.

The process conditions for forming adhesion-promoting anodic oxide layer 306 will depend, in part, on the type of electrolyte used, a desired thickness and a desired pore structure. In some embodiments, it is preferable that the same current density used to form cosmetic anodic oxide layer 304 is used to form adhesion-promoting anodic oxide layer 306, thereby providing similar anodic oxide growth rates. However, higher or lower current densities can also be used. In addition, the voltage can be controlled in forming one or more of cosmetic anodic oxide layer 304 and adhesion-promoting anodic oxide layer 306 in order to affect pore sizes, which is discussed in detail below with reference to FIGS. 5A and 5B. In particular embodiments, an oxalic acid electrolyte having a concentration between about 10 grams/liter and about 90 grams/liter is used. In more particular embodiment, an oxalic acid electrolyte concentration of about 30 grams/liter is used.

In some embodiments, one or more of cosmetic anodic oxide layer 304 and adhesion-promoting anodic oxide layer 306 are dyed to have a desired color. For example, one or more dyes, pigments or metal materials can be infused within the pores of one or more of cosmetic anodic oxide layer 304 and adhesion-promoting anodic oxide layer 306 to give anodic oxide coating 308 a corresponding color. In some embodiments, a pore widening process is used to widen the pores within one or more of cosmetic anodic oxide layer 304 and adhesion-promoting anodic oxide layer 306. This pore widening can allow more colorant to be deposited within the pores. In some embodiments, one or more of cosmetic anodic oxide layer 304 and adhesion-promoting anodic oxide layer 306 are further sealed using a suitable sealing process.

As described above, the color of anodic oxide coating 308 coating can also be controlled by varying anodizing process parameters and/or a thickness of adhesion-promoting oxide layer 306. Thus, in some cases adhesion-promoting oxide layer 306 can be referred to as a color-controlling anodic oxide layer. In particular, process parameters that can affect the color anodic oxide coating 308 can include electrolyte concentration, temperature and current density that is applied during an anodizing process. In some cases, the thickness of the adhesion-promoting oxide layer 306 is the strongest controlling factor of color. In general, thinner layers tend to have lighter coloration, and the coloration becomes more intense with growing thickness. However, because application in consumer electronics generally require a certain minimum thickness of anodic oxide coating 308 in order to provide sufficient surface hardness and wear protection to the substrate 302, some lighter and more subtle color shades cannot be used as they correspond to insufficient oxide thicknesses. In the present paper, this problem is overcome by complementing the thickness of the adhesion-promoting anodic oxide layer 306 with a thickness of cosmetic anodic oxide layer 304, such that the thickness of anodic oxide coating 308 can be independently controlled from the color of anodic oxide coating 308.

Note that in some embodiments, one or more additional anodic layers are formed after formation of adhesion-promoting anodic oxide layer 306. These embodiments are not shown in the Figures for purposed of simplicity. However, is should be understood that the methods described herein are not limited to anodic oxide coatings having only two anodic oxide layers. Each successive anodic oxide layer is formed by conversion of a corresponding portion of a substrate. The anodic oxide layer that is formed last will correspond to the anodic oxide layer that directly interfaces with the substrate. Thus, the anodizing process conditions for forming the anodic oxide layer that directly interfaces with the substrate can be optimized to promote adhesion.

Figure 3C:
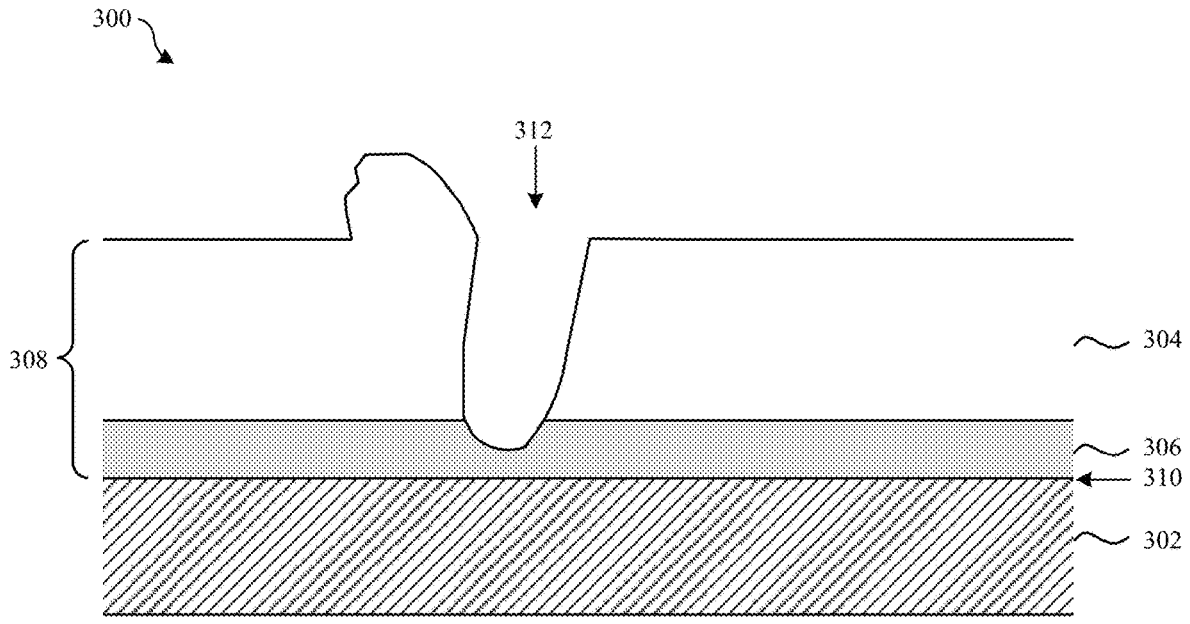
FIG. 3C shows a cross-section view of the part shown in FIGS. 3A and 3B after exposure to an impact event.

FIG. 3C shows a cross-section view of part 300 after being subject to an impact event, such as exposure to a scratching, chipping or similar impact force. As shown, the impact event is sufficiently forceful so as to cause chip 312 to form within cosmetic anodic oxide layer 304 as well as a portion of adhesion-promoting anodic oxide layer 306. However, because of anodic oxide layer 304 is firmly adhered to substrate 302 at interface 310, the impact force is not sufficient to delaminate anodic oxide coating 308 from substrate 302. That is, the stronger bond between anodic oxide layer 306 and substrate 302 at interface 310 makes chip 312 more likely to be confined within anodic oxide coating 308 and less likely to cause delamination of anodic oxide coating 308 and exposure of substrate 302. In this way, part 300 is less likely than part 200 (in FIG. 2) to have visibly and/or tactilely apparent chips, scratches, etc.

As described above, in some embodiments an organic acid electrolyte (e.g., oxalic acid electrolyte) is used to form adhesion-promoting anodic oxide layer 306 in order to provide good adhesion at interface 310. However, in some cases, anodizing in an organic acid electrolyte can impart discoloration on adhesion-promoting anodic oxide layer 306. In particular, an oxalic acid electrolyte can cause anodic oxide layer 306 to have a gold, bronze or yellowish hue, which may be unacceptable for applications where a substantially colorless and transparent anodic layer is desired. Citric acid, malic acid and malonic acid electrolytes can be even less desirable since these electrolytes can result in anodic oxide layer 306 having an even darker yellow or brown color. Thus, it may be desirable to minimize the relative thickness of adhesion-promoting anodic oxide layer 306 compared to cosmetic anodic oxide layer 304 in order to achieve a final color for coating that is within an acceptable color range. The different thickness of first 304 and second 306 anodic oxide layers can be achieved by exposing substrate 302 to the corresponding anodizing processes for different amounts of time. This additional degree of color control may be desirable in achieving subtle color variants such as very light shades of gold, bronze, or gray.

Figure 4:
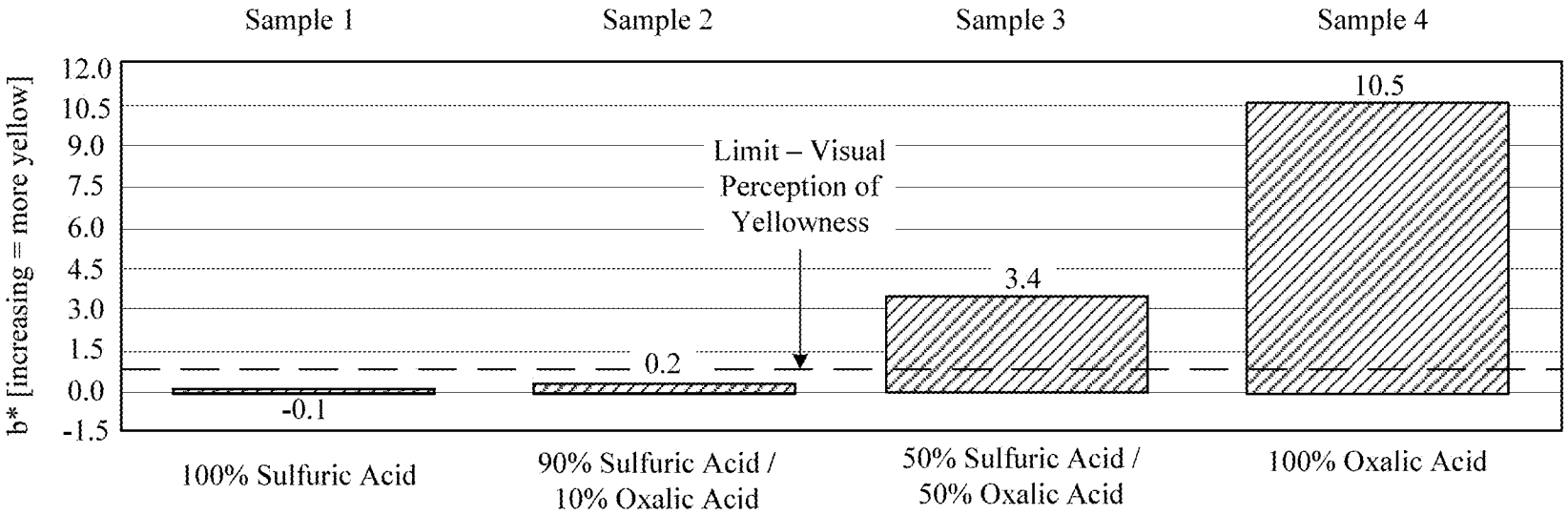
FIG. 4 shows a graph indicating a relationship between b* color opponent dimension values and relative anodizing exposure times for forming anodic oxide coatings.

FIG. 4 shows a graph indicating a relationship between relative anodizing exposure times and a color of a resultant anodic oxide coating for some sample substrates. FIG. 4 shows b* color opponent dimension values for four zinc-containing aluminum alloy samples (Samples 1, 2, 3 and 4) having different anodic oxide coatings. The b* color opponent dimension value is one variable in L*a*b* color space (or CIELAB). In general, L*a*b* color space is a model used to plot colors of an object according to color opponents L* corresponding to an amount of lightness, a* corresponding to amounts of green and magenta, and b* corresponding to amounts of blue and yellow. Negative a* values indicate a green color while positive a* values indicate a magenta color. Negative b* values indicate a blue color and positive b* values indicate a yellow color. Thus, samples having more positive b* indicate a more yellow color. Color measurements of Samples 1, 2, 3 and 4 can be carried out using, for example, a color spectrometer.

As shown at FIG. 4, Sample 1 includes an anodic oxide coating formed by exposing a substrate for 100% of the anodizing time in a sulfuric acid electrolyte. Sample 1 has a b* value of about −0.1, indicating substantially no yellow color component. Sample 2 includes an anodic oxide coating formed by exposing a substrate for 90% of the anodizing time in a sulfuric acid electrolyte (forming the cosmetic anodic oxide layer) and 10% of the anodizing time in an oxalic acid electrolyte (forming the adhesion-promoting anodic oxide layer). Sample 2 has a b* value of about 0.2, indicating a very slight yellow color component. Sample 3 includes an anodic oxide coating formed by exposing a substrate for 50% of the anodizing time in a sulfuric acid electrolyte (forming the cosmetic anodic oxide layer) and 50% of the anodizing time in an oxalic acid electrolyte (forming the adhesion-promoting anodic oxide layer). Sample 3 a b* value of about 3.4, indicating more of a yellow color component. Sample 4 includes an anodic oxide coating formed by exposing a substrate for 100% of the anodizing time in an oxalic acid electrolyte. Sample 4 has a b* value of about 10.5, indicating a substantially yellow color component.

The chart of FIG. 4 shows that the amount of yellow of an anodic oxide coating using the multilayered anodizing process described herein can be controlled by adjusting the relative anodizing times of each of the anodizing processes for forming cosmetic anodic oxide layer and adhesion-promoting anodic oxide layer. More specifically, the longer time relative time spent anodizing using the adhesion-promoting anodic oxide layer, the thicker the adhesion-promoting anodic oxide layer will be and the yellower the resultant anodic oxide coating will be. Furthermore, by correlating b* value with relative amounts of anodizing time can allow accurate process control parameters for designing a process for a particular application. For example, FIG. 4 shows a dashed line label Limit-Visual Perception of Yellowness to denote a maximum acceptable b* value limit for an example process. For example, a particular process may require a b* value of about 1.0 or less.

Choosing the proportion of cosmetic anodic oxide layer to adhesion-promoting anodic oxide layer can also depend on a final color of a part. For example, if the part is to be dyed a dark color, such as black, a relatively high proportion of the adhesion-promoting anodic oxide layer (e.g., 40% or higher) can be used. The higher proportion of adhesion-promoting anodic oxide layer can minimize a residual stress at the interface between the adhesion-promoting anodic oxide layer and the substrate, thereby provide better adhesion. In a particular embodiment where the part is dyed a dark color, preferably about 50% of the anodizing time is conducted in the sulfuric acid electrolyte, yielding an anodic oxide coating comprised of about 50% cosmetic anodic oxide layer by thickness.

If, on the other hand, the part is to be used in an un-dyed condition, or with a light dye color is used, it may be desirable to form a relatively lower proportion (e.g., 20% or lower) of adhesion-promoting anodic oxide layer. The lower proportion of adhesion-promoting anodic oxide can provide an anodic oxide coating with less discoloration, yet gains some minimizing of residual stress at the interface between the adhesion-promoting anodic oxide layer and the substrate. In a particular embodiment wherein the anodic oxide coating is undyed and preferably clear, preferably about 98% of the anodizing time is conducted in a sulfuric acid electrolyte, with only about 2% of the anodizing time is conducted in an organic acid electrolyte.

Figure 5A:
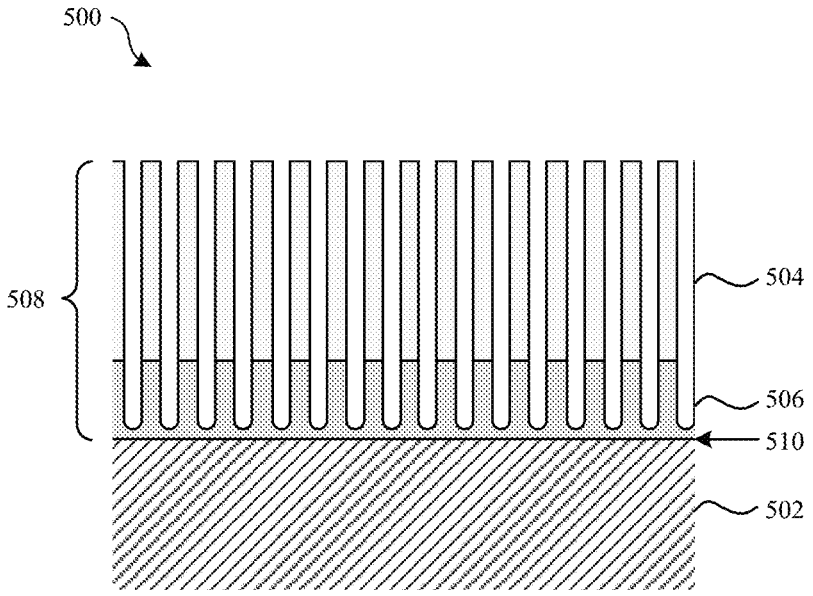
FIGS. 5A and 5B show cross-section views showing multilayered anodic oxide coatings of two different parts having two different pore structures, in accordance with described embodiments.
Figure 5B:
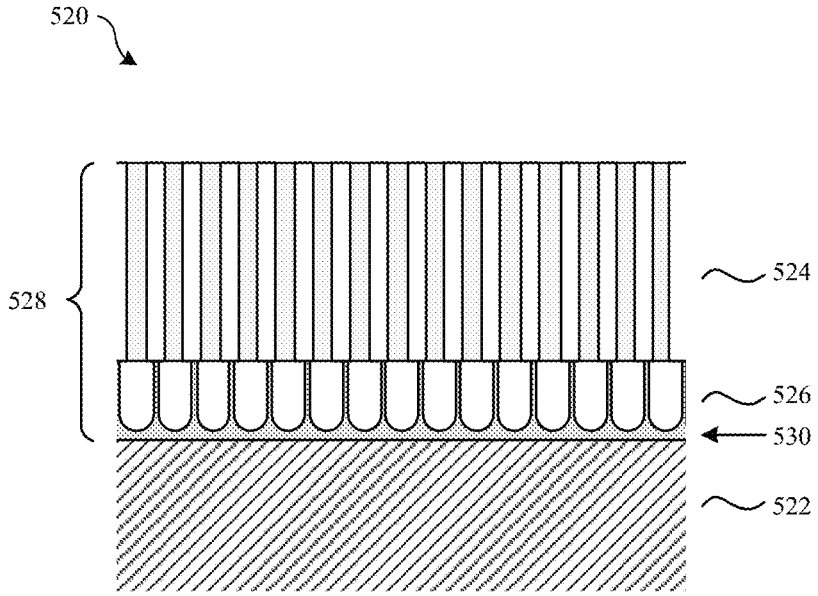

The pore structures of the cosmetic anodic oxide layer and adherence-promoting anodic oxide layers can be varied in accordance with particular application requirements. FIGS. 5A and 5B show cross-section views showing multilayered anodic oxide coatings of two different parts having two different pore structures, in accordance with described embodiments. FIG. 5A shows a surface portion of part 500 having anodic coating 508 that is integrally formed on substrate 502. Anodic coating 508 includes cosmetic anodic oxide layer 504 and adhesion-promoting anodic oxide layer 506, with adhesion-promoting anodic oxide layer 506 contacting substrate at interface 510. Each of cosmetic anodic oxide layer 504 and adhesion-promoting anodic oxide layer 506 has a series of pores formed during anodizing. Although cosmetic anodic oxide layer 504 and adhesion-promoting anodic oxide layer 506 are formed using different anodizing electrolytes, the anodizing process conditions used to form each of cosmetic anodic oxide layer 504 and adhesion-promoting anodic oxide layer 506 can be chosen such that the diameters of the pores within cosmetic anodic oxide layer 504 are substantially the same as the diameters of the pores within adhesion-promoting anodic oxide layer 506. This can be accomplished, for example, by adjusting anodizing parameters based on the types of electrolytes used in each of the anodizing processes. In some cases, even though different electrolytes are used, similar anodizing parameters can be used. For example, forming cosmetic anodic oxide layer 504 in a sulfuric acid electrolyte and forming adhesion-promoting anodic oxide layer 506 in an oxalic acid electrolyte can sometimes involve using the same or similar process parameters (e.g., current densities).

FIG. 5B shows a surface portion of part 520 having anodic coating 528, which includes cosmetic anodic oxide layer 524 and adhesion-promoting anodic oxide layer 526, with adhesion-promoting anodic oxide layer 526 contacting substrate at interface 530. In contrast to part 500 in FIG. 5A, the average pore size of cosmetic anodic oxide layer 524 differs from the average pore size of adhesion-promoting anodic oxide layer 526. In particular, the pores within adhesion-promoting anodic oxide layer 526 are larger than the diameters of pores within cosmetic anodic oxide layer 524. In some cases, this can provide anodic oxide coating 528 a different visual appearance compared to anodic oxide coating 508 in FIG. 5A. These differing pore sizes can be accomplished, for example, by using different anodizing voltages in forming each of cosmetic anodic oxide layer 504 and adhesion-promoting anodic oxide layer 506. In general, higher voltages are associated with larger pore sizes. Note that in other embodiments, the pores within cosmetic anodic oxide layer 526 are larger than the diameters of pores within adhesion-promoting anodic oxide layer 524.

Figure 6A:
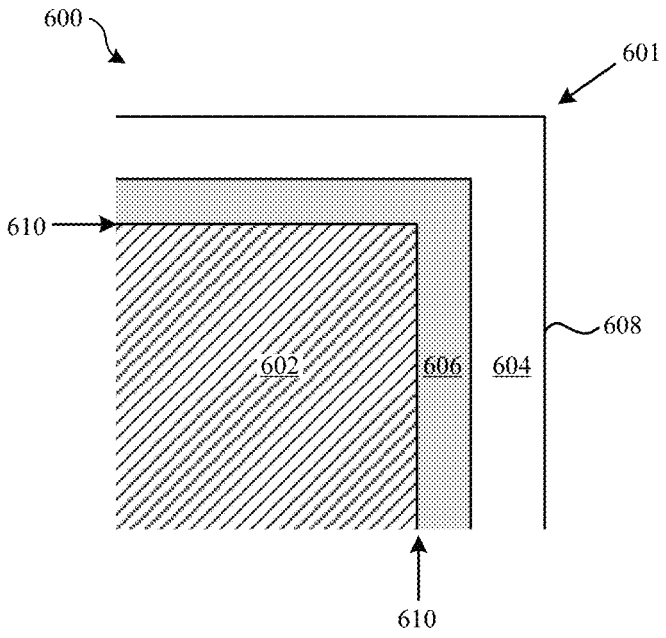
FIGS. 6A and 6B show cross-section views of portions of parts having different geometries with multi-layered anodic coatings, in accordance with described embodiments.
Figure 6B:
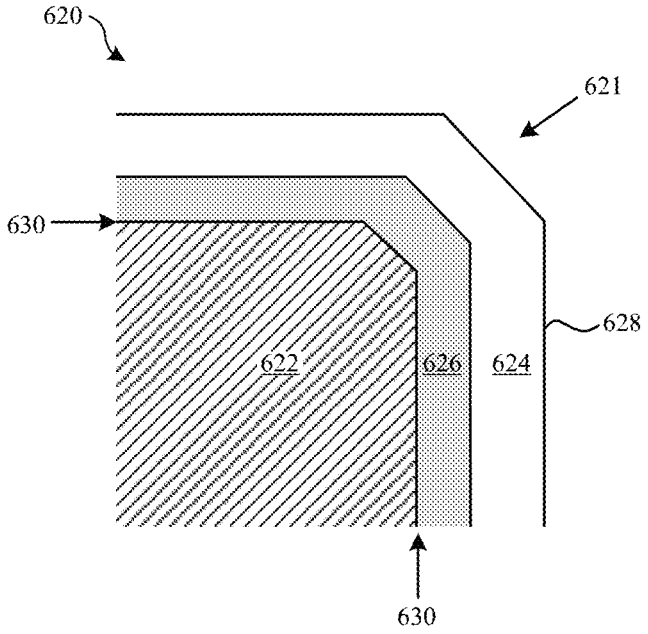

FIGS. 6A and 6B show cross-section views of portions of parts having different geometries with multi-layered anodic coatings, in accordance with described embodiments. FIG. 6A shows part 600, which includes edge 601. Edge 601 can correspond, for example, to an edge or corner portion of a housing for an electronic device, such as one of devices 102, 104 and 106. Part 600 has anodic oxide coating 608 formed on substrate 602. Due to geometry, edge 601 can be subject to impact forces, such as scratching, chipping and gouging forces. Anodic oxide coating 608 is integrally formed on surface of edge 601, thereby protecting edge from chipping, etc. Anodic oxide coating 608 includes cosmetic anodic oxide layer 604 and adhesion-promoting anodic oxide layer 606, as described in embodiments above. Adhesion-promoting layer 606 provides good adhesion at interface 610 such that anodic oxide coating 608 is secured to substrate 602 when part 600 is exposed to the impact forces. In some cases, edge 601 is at a relatively sharp angle, such as at a 90 degree angle or less. In addition, interface 610 at edge 601 can be subject to stress concentrations due to thermally and/or mechanically induced strain. Formation of adhesion-promoting layer 606 strengthens interface 610 such that oxide coating 608 is secured to substrate 602 despite these stress concentrations.

FIG. 6B shows part 620, which includes dual edge 621, sometimes referred to as a chamfered edge. Like edge 600, dual edge 621 can correspond an edge or corner portion of a housing for an electronic device, such as one of devices 102, 104 and 106. Anodic oxide coating 628 is integrally formed on and protects substrate 622, including at dual edge 621. Anodic oxide coating 628 includes cosmetic anodic oxide layer 624 and adhesion-promoting anodic oxide layer 626, as described in embodiments above. Adhesion-promoting layer 626 provides good adhesion at interface 630 such that anodic oxide coating 628 is secured to substrate 622 when part 620 is exposed to the impact forces, as well as stress concentrations due to the geometry of dual edge 621.

Figure 7:
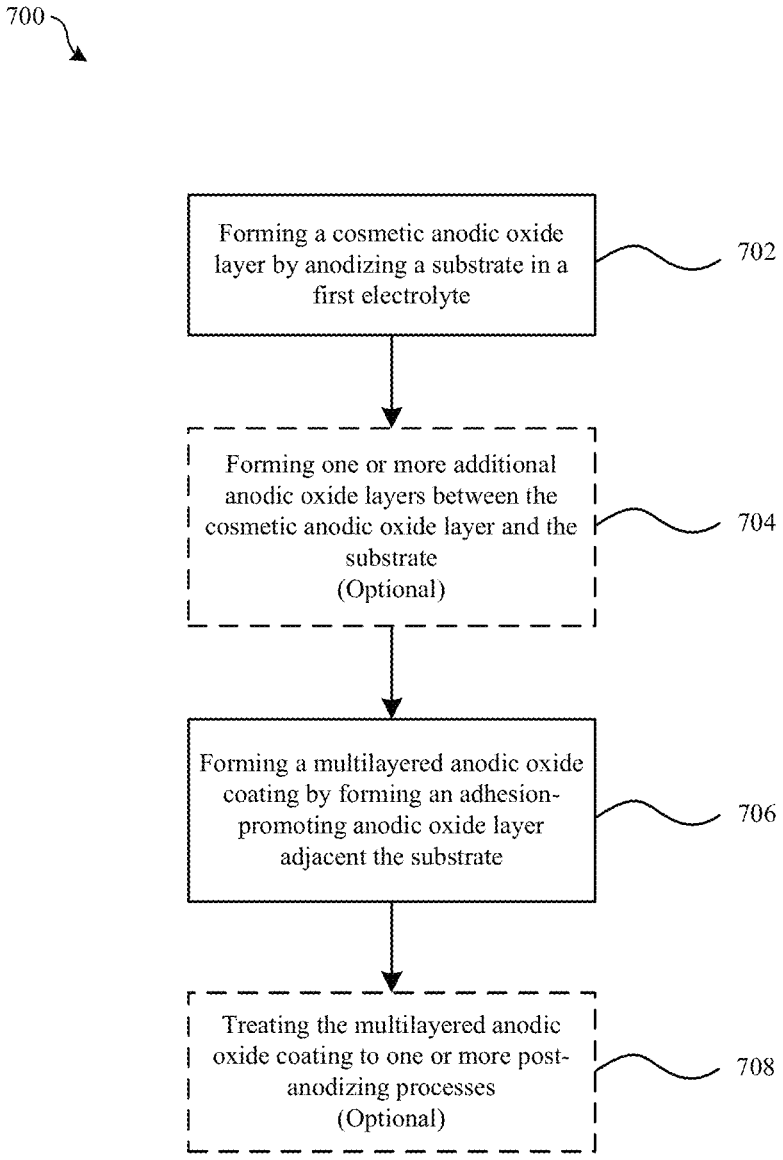
FIG. 7 shows a flowchart that indicates a process for forming a multilayered anodic oxide coating, in accordance with described embodiments.

FIG. 7 shows high-level flowchart 700, which indicates a process for forming a multilayered anodic oxide coating, in accordance with described embodiments. At 702, a cosmetic anodic oxide layer is formed by anodizing a substrate in a first electrolyte. The substrate can include any suitable anodizable material and can include metal alloys. In some embodiments, the metal alloys include alloying agents such as zinc. The surface of the substrate being anodized can have any suitable texture. For example, the substrate surface can have a roughened surface produced by any of a number of suitable texturing processes such as one or more chemical etching, laser etching and blasting operations. Alternatively, the substrate surface can be smooth produced by any of a number of suitable buffing and/or polishing operations.

The cosmetic anodic oxide layer corresponds to an outer anodic oxide layer and includes an exterior surface corresponding to an outer surface of the multilayered anodic oxide coating. The first electrolyte can have a chemical composition chosen to provide a particular appearance and/or tactile quality. In some embodiments, the first electrolyte can include sulfuric acid and/or phosphoric acid to provide a substantially colorless and transparent appearance to the cosmetic anodic oxide layer. In embodiments where a sulfuric acid electrolyte is used, the cosmetic anodic oxide layer can include sulfur or sulfur-containing species.

At 704, one or more additional anodic oxide layers are optionally formed between the cosmetic anodic oxide layer and the substrate. These additional anodic oxide layers can be formed using any of a number of the same or different anodizing process to form anodic oxide layers having any of a number of different appearance and/or tactile quality to give the multilayered anodic oxide coating a particular final appearance and/or tactile quality. In some cases, the one or more additional anodic oxide layers can have different hardnesses or tensile strengths that provide a cumulative hardness or strength the final multilayered anodic oxide coating.

At 706, the multilayered anodic oxide coating is formed by forming an adhesion-promoting anodic oxide layer adjacent the substrate. The adhesion-promoting anodic oxide layer can be formed by anodizing the substrate in a second electrolyte different than the first electrolyte. The second electrolyte is characterized has having a chemical composition that prevents at least one alloying agent in the substrate from transforming into a delaminating compound at an interface between the adhesion-promoting anodic oxide layer and the substrate. The delaminating compound is associated with reducing adhesion strength between the anodic oxide coating and the substrate. For example, a zinc, which is an alloying agent used in some aluminum alloys, is prevented from forming a zinc and sulfur containing compound that has been shown to cause delamination of an anodic oxide coating when accumulated at the interface between the anodic oxide coating and the substrate. Thus, in some embodiments, the second electrolyte that is substantially free of sulfur-containing species.

As described above, the relative thicknesses of the cosmetic anodic oxide layer and the adhesion-promoting oxide layer can be controlled based on a desired final color and/or structural property, such as a final hardness. In some embodiments, the anodic oxide coating is dyed with a dark colored dye, such as a black dye. In these cases, any discoloration of cosmetic anodic oxide layer and the adhesion-promoting oxide layer may not be important. Thus, in these cases, the adhesion-promoting oxide layer may be formed at a relatively large thickness (e.g., 50% or more of the anodic oxide coating thickness). In other embodiments, a subsequent dying process is not implemented and the anodic oxide coating is preferably colorless and transparent. In these cases, the cosmetic anodic oxide layer is formed in an electrolyte and using anodizing parameters consistent with providing a substantially colorless and transparent cosmetic anodic oxide layer. In addition, adhesion-promoting oxide layer may be formed at a relatively small thickness (e.g., 10% or less of the anodic oxide coating thickness) in order to minimize discoloration cause by the presence of the adhesion-promoting oxide layer. In further embodiments, a precise color may be imparted by a controlled thickness of the colored oxide, combined with a thickness of colorless oxide to make up the majority of the oxide thickness. This may be used to generate light yellow, bronze or gold shades.

At 708, the multilayered anodic oxide coating is optionally treated to one or more post-anodizing processes. The types of post-anodizing processes will depend upon the nature of the multilayered anodic oxide coating as well as specific application requirements. For example, the multilayered anodic oxide coating can be colored by infusing one or more dyes within the pores of the multilayered anodic oxide coating. In some cases, a pore-widening process is used to widen the pores prior to dye infusion in order to accommodate more dye particles. In some embodiments, the multilayered anodic oxide coating is sealed using a suitable sealing process. Note that one or more rinsing processes can be performed, as needed, between any of 702, 704, 706 and 708 described above.

Figure 8:
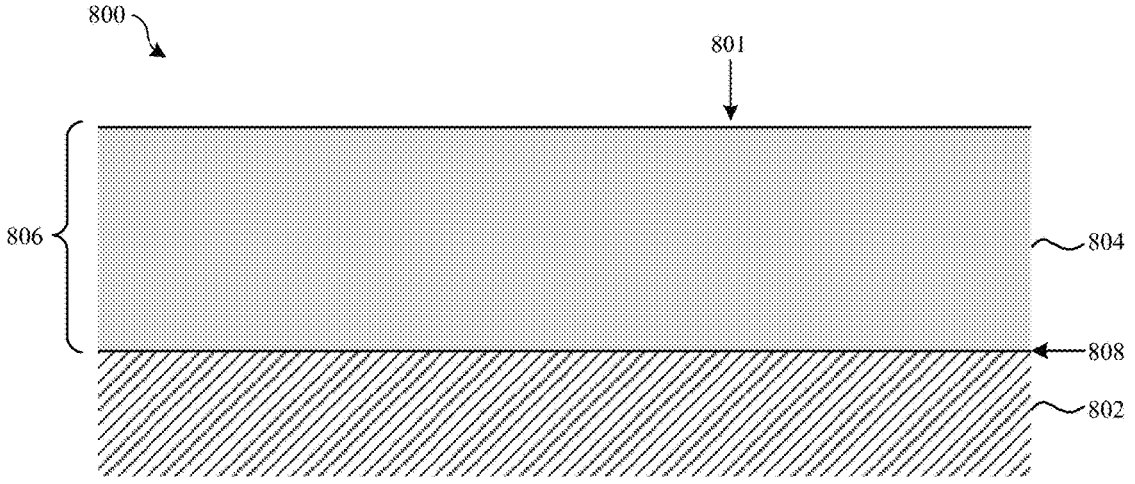
FIG. 8 shows a cross section view of a surface of a part having an adhesion-promoting anodic oxide layer, in accordance with described embodiments.

According to some embodiments, a single adhesion-promoting anodic oxide layer is formed on a substrate that includes one or more types of alloying agents that has the potential to cause delamination using conventional anodizing techniques. FIG. 8 shows a cross section view of a surface of part 800 having adhesion-promoting anodic oxide layer 804 formed on substrate 802. Substrate 802 can include one or more types of alloying agents, such as zinc, that can cause a conventional sulfuric acid anodic oxide coating to delaminate, as described above with reference to FIG. 2. In a particular embodiment, substrate 802 is a high-strength aluminum alloy that includes zinc (e.g., certain 7000 series alloys). The one or more alloying agents can become enriched at interface 808, as described above.

Adhesion-promoting anodic oxide layer 804 is formed using an anodizing process using an electrolyte that is substantially free of chemical species that can combine with alloying agents enriched at interface 808 to form delaminating compounds. In some cases, this means adhesion-promoting anodic oxide layer 804 is substantially free of sulfur, which can combine with zinc to form sulfur-containing delaminating compounds, as describe above. In some embodiments, adhesion-promoting anodic oxide layer 804 is formed using an organic acid anodizing electrolyte, such as an electrolyte having one or more of oxalic acid, citric acid, malic acid, malonic acid, glycolic acid, acetic acid and tartaric acid. In some embodiments, adhesion-promoting anodic oxide layer 804 is formed using an inorganic acid anodizing electrolyte that is substantially free of sulfur, such as phosphoric acid.

Note that part 800 has a single layered anodic coating, adhesion-promoting anodic oxide layer 804. Thus, surface 801 corresponds to an exposed surface of adhesion-promoting anodic oxide layer 804 as well as an external surface of part 800. This arrangement may be useful in applications where substrate 802 may be prone to delamination using conventional anodizing electrolyte processes (i.e., due to certain alloying agents) and where a single layered anodic oxide layer is desired.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not target to be exhaustive or to limit the embodiments to the precise forms disclosed. It will be apparent to one of ordinary skill in the art that many modifications and variations are possible in view of the above teachings.

What is claimed is:

1. A part, comprising:

a substrate comprised of an aluminum alloy that includes zinc; and an anodic oxide coating disposed on the substrate and characterized as having a b* color opponent dimension value of 0.2 or less, the anodic oxide coating comprising:

a cosmetic anodic oxide layer, and an adhesion-promoting anodic oxide layer positioned between the cosmetic anodic oxide layer and the substrate and adhered to the substrate, the adhesion-promoting anodic oxide layer including about 3% or less by weight of sulfur or sulfur-containing species, wherein each of the cosmetic and adhesion-promoting anodic oxide layers has pores, and wherein the pores within the adhesion-promoting anodic oxide layer have diameters that are larger than diameters of the pores within the cosmetic anodic oxide layer, and the adhesion-promoting anodic oxide layer constitutes more than 0% and no more than 10% of a thickness of the anodic oxide coating.

2. The part of claim 1, wherein the anodic oxide coating includes dye particles.

3. The part of claim 1, wherein the adhesion-promoting anodic oxide layer further constitutes between about 2% and about 10% of the thickness of the anodic oxide coating.

4. The part of claim 1, wherein the adhesion-promoting anodic oxide layer is formed in an electrolyte that includes an organic acid.

5. The part of claim 4, wherein the organic acid includes at least one of oxalic acid, citric acid, malic acid, malonic acid, glycolic acid, acetic acid, or tartaric acid.

6. The part of claim 1, wherein a thickness of the cosmetic anodic oxide layer is between about 5 micrometers to about 30 micrometers.

7. The part of claim 1, wherein the anodic oxide coating is disposed on an edge or a corner of the substrate.

8. The part of claim 1, wherein the adhesion-promoting anodic oxide layer includes 1% or less by weight of sulfur or sulfur containing species.

9. The part of claim 1, wherein the anodic oxide coating includes one or more additional anodic oxide layers.

10. A part, comprising:

a substrate including an aluminum alloy; and an oxide coating disposed on the substrate, the oxide coating characterized as having a b* color opponent value of 0.2 or less, the oxide coating including:

a first porous anodic oxide layer, and a second porous anodic oxide layer positioned between the first porous anodic oxide layer and the substrate, the second porous anodic oxide layer having pores with diameters that are larger than diameters of pores within the first porous anodic oxide layer, wherein the second porous anodic oxide layer includes about 3% or less by weight of sulfur or sulfur-containing species, and wherein the second porous anodic oxide layer constitutes more than 0% and no more than 10% of a thickness of the oxide coating.

11. The part of claim 10, wherein the part is an enclosure for an electronic device.

12. The part of claim 10, wherein the second porous anodic oxide layer is formed in an electrolyte that includes an organic acid.

13. The part of claim 12, wherein the organic acid includes at least one of oxalic acid, citric acid, malic acid, malonic acid, glycolic acid, acetic acid, or tartaric acid.

14. An electronic device, comprising:

an enclosure composed of an aluminum alloy substrate; and an oxide coating formed on the aluminum alloy substrate, the oxide coating characterized as having a b* color opponent value no greater than 0.2, the oxide coating including:

a first porous anodic oxide layer, and a second porous anodic oxide layer positioned between the first porous anodic oxide layer and the aluminum alloy substrate, and the second porous anodic oxide layer having pores with diameters that are larger than diameters of pores within the first porous anodic oxide layer, wherein the second porous anodic oxide layer includes no greater than 3% by weight of sulfur or sulfur-containing species, and wherein the second porous anodic oxide layer constitutes between 50% or more and less than 100% of a thickness of the oxide coating.

15. The electronic device of claim 14, wherein the second porous anodic oxide layer is thicker than the first porous anodic oxide layer.

16. The electronic device of claim 14, wherein the second porous anodic oxide layer includes no greater than about 1% by weight of sulfur or sulfur containing species.

17. The electronic device of claim 14, wherein the aluminum alloy substrate includes at least one of silicon, iron, copper, manganese, magnesium, chromium, vanadium, titanium, bismuth, gallium, lead or zirconium.

18. The electronic device of claim 14, wherein the first porous anodic oxide layer has a thickness of between 5 micrometers and 30 micrometers.

* * * * *